US010147348B2

(12) United States Patent
Kim et al.

(10) Patent No.: US 10,147,348 B2
(45) Date of Patent: Dec. 4, 2018

(54) VOLTAGE CONVERSION CIRCUIT AND ORGANIC LIGHT-EMITTING DEVICE HAVING SAME

(71) Applicant: LG DISPLAY CO., LTD., Seoul (KR)

(72) Inventors: Tae Woo Kim, Paju-si (KR); Sangyong Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 13 days.

(21) Appl. No.: 15/391,460

(22) Filed: Dec. 27, 2016

(65) Prior Publication Data

US 2017/0193881 A1 Jul. 6, 2017

(30) Foreign Application Priority Data

Dec. 31, 2015 (KR) ..... 10-2015-0191835

(51) Int. Cl.

| | |
|---|---|
| ***G09G 3/20*** | (2006.01) |
| ***G09G 3/3291*** | (2016.01) |
| ***G09G 3/3266*** | (2016.01) |
| ***G09G 3/3233*** | (2016.01) |

(52) U.S. Cl.

CPC ..... *G09G 3/2074* (2013.01); *G09G 3/3233* (2013.01); *G09G 3/3266* (2013.01); *G09G 3/3291* (2013.01); *G09G 2300/0809* (2013.01); *G09G 2300/0842* (2013.01); *G09G 2300/0866* (2013.01); *G09G 2310/0286* (2013.01); *G09G 2310/0291* (2013.01); *G09G 2310/08* (2013.01); *G09G 2320/0233* (2013.01);

(Continued)

(58) Field of Classification Search

CPC ..... G09G 3/3266; G09G 3/3291; G09G 2300/0809; G09G 2310/08; G09G 2310/0286; G09G 2310/0291; G09G 3/3233; G09G 2330/028; G09G 2300/0866; G09G 2320/0233; G09G 2320/0295; G09G 2320/043; G09G 2330/021; G09G 3/20

See application file for complete search history.

(56) References Cited

U.S. PATENT DOCUMENTS

2006/0012310 A1* 1/2006 Chen ..... G09G 3/3233 315/169.3
2011/0157134 A1* 6/2011 Ogura ..... G09G 3/20 345/211

(Continued)

FOREIGN PATENT DOCUMENTS

CN 102110412 A 6/2011
CN 104751793 A 7/2015

*Primary Examiner* — Md Saiful A Siddiqui
(74) *Attorney, Agent, or Firm* — Seed Intellectual Property Law Group LLP

(57) ABSTRACT

A voltage conversion circuit includes a reference voltage setting unit configured to generate a positive voltage and a negative voltage to be supplied to a display panel, an amplifier, and first and second switching units disposed between the output terminal of the amplifier and the ground. Accordingly, it is possible to selectively output different base voltages. An organic light-emitting display device includes a display panel, a data driver, a gate driver, a voltage supply unit, and a voltage conversion unit configured to selectively supply different base voltages. Accordingly, it is possible to selectively output a base voltage to be supplied to a cathode of an organic light-emitting diode of each sub pixel.

18 Claims, 12 Drawing Sheets

(52) U.S. Cl.
CPC ..... *G09G 2320/0295* (2013.01); *G09G 2320/043* (2013.01); *G09G 2330/021* (2013.01); *G09G 2330/028* (2013.01)

(56) References Cited

U.S. PATENT DOCUMENTS

| | | | | |
|---|---|---|---|---|
| 2011/0279433 | A1* | 11/2011 | Ryu | G09G 3/3233 345/211 |
| 2013/0050292 | A1* | 2/2013 | Mizukoshi | G09G 3/3291 345/690 |
| 2014/0009512 | A1* | 1/2014 | Lee | G09G 5/02 345/690 |

* cited by examiner

VOLTAGE CONVERSION CIRCUIT AND ORGANIC LIGHT-EMITTING DEVICE HAVING SAME

CROSS-REFERENCE TO RELATED APPLICATION

This application claims priority from Korean Patent Application No. 10-2015-0191835, filed on Dec. 31, 2015, which is hereby incorporated by reference for all purposes as if fully set forth herein.

BACKGROUND

Technical Field

The present disclosure relates to a voltage conversion circuit and an organic light-emitting display device having the voltage conversion circuit.

Description of the Related Art

Organic light-emitting display devices having recently attracted attention as display devices employ organic light-emitting diodes (OLED) that emit light by themselves, and thus have great advantages such as a high response speed, high emission efficiency, high luminance, and a large viewing angle.

In such organic light-emitting display devices, sub pixels including an organic light-emitting diode are arranged in a matrix and brightness of the sub pixels selected by a scan signal is controlled on the basis of gray scales of data.

Each sub pixel in such organic light-emitting display devices generally includes a driving transistor that drives the organic light-emitting diode, a switching transistor that transmits a data voltage to a gate node of the driving transistor, and a storage capacitor that functions to hold a constant voltage for one frame time.

The driving transistor of each sub pixel degrades with extension of a driving time and thus characteristics of the driving transistor such as a threshold voltage and mobility thereof may be varied. Since a degree of degradation may differ depending on the particular driving transistors, a characteristic deviation may occur between the driving transistors of the sub pixels.

The organic light-emitting diode of each sub pixel also degrades with extension of the driving time and thus characteristics such as a threshold voltage may be varied. Since the degree of degradation may differ depending on the organic light-emitting diodes, a characteristic deviation may occur between the organic light-emitting diodes of the sub pixels.

As described above, the characteristic deviation between the sub pixels may cause a luminance deviation between the sub pixels and may cause screen abnormality such as a screen afterimage or luminance unevenness in a display panel.

Therefore, techniques of compensating for the characteristic deviation between the sub pixels have been developed. In a compensation method of the techniques, when an organic light-emitting display device operates in a sensing mode, characteristics of the driving transistor or the organic light-emitting diode of each sub pixel are sensed to acquire sensed values (Vsen) and data to be supplied to the sub pixel is compensated for on the basis of the sensed values (Vsen).

An organic light-emitting display device may operate in a display mode for displaying an image and a sensing mode for compensating for a characteristic deviation between sub pixels. A base voltage (EVSS) supplied to a cathode (a second electrode) of the organic light-emitting diode of each sub pixel may differ depending on the modes.

As described above, since voltage sources corresponding to the modes should be provided for supplying different base voltages (EVSS) to the display panel, there are disadvantages that circuits are complicated and the number of components to be added also increases.

BRIEF SUMMARY

An object of the present disclosure is to provide a voltage conversion circuit that can selectively output a base voltage to be supplied to a cathode of an organic light-emitting diode of each sub pixel depending on whether a display panel operates in a display mode or in a sensing mode, and an organic light-emitting display device including the voltage conversion circuit.

According to an aspect of the present disclosure, there is provided a voltage conversion circuit including: a reference voltage setting unit configured to generate a positive voltage and a negative voltage to be supplied to a display panel; an amplifier configured to be supplied with the positive voltage or the negative voltage output from the reference voltage setting unit via an input terminal and to output the positive voltage or the negative voltage from an output terminal; and first and second switching units disposed between the output terminal of the amplifier and the ground. Accordingly, it is possible to selectively output a base voltage to be supplied to a cathode of an organic light-emitting diode of each sub pixel.

According to another aspect of the present disclosure, there is provided an organic light-emitting display device including: a display panel in which data lines and gate lines are arranged to interest each other and a plurality of sub pixels are arranged; a data driver configured to supply a data voltage to the display panel via the data lines; a gate driver configured to supply a scan signal to the display panel via the gate lines; a timing controller configured to control driving timings of the data driver and the gate driver; a voltage supply unit configured to supply a voltage to the timing controller and the gate driver; and a voltage conversion unit configured to selectively supply different base voltages to the display panel when the display panel operates in a display mode and in a sensing mode. Accordingly, it is possible to selectively output a base voltage to be supplied to a cathode of an organic light-emitting diode of each sub pixel.

According to the voltage conversion circuit and the organic light-emitting display device including the voltage conversion circuit of the present disclosure, it is possible to selectively output a base voltage to be supplied to a cathode of an organic light-emitting diode of each sub pixel depending on whether a display panel operates in a display mode or in a sensing mode.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

Figure 1:
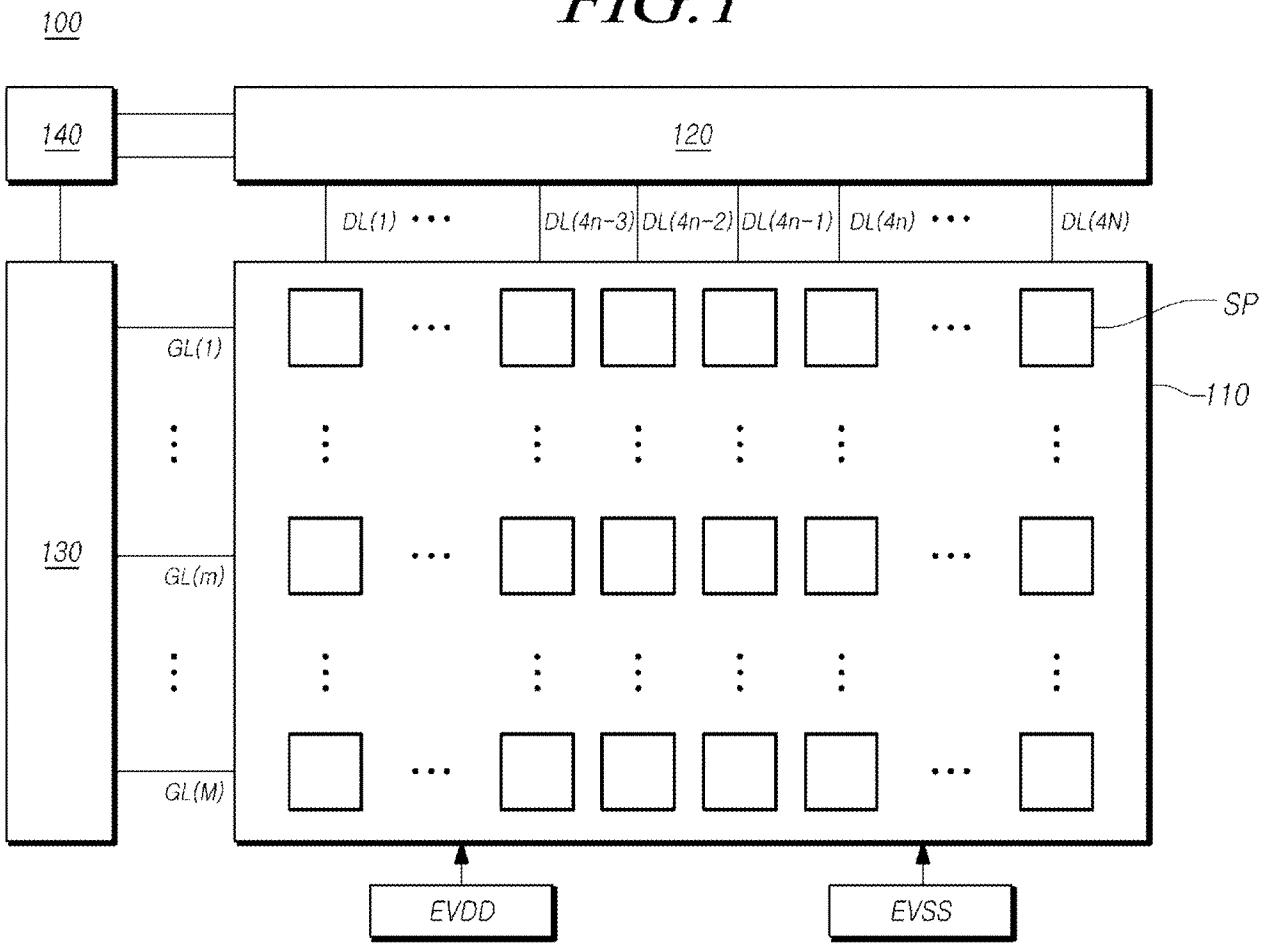
FIG. 1 is a diagram illustrating a system configuration of an organic light-emitting display device according to one or more embodiments of the present disclosure.

Hereinafter, some embodiments of the present disclosure will be described in detail with reference to the accompanying illustrative drawings. In referencing elements of the drawings by reference numerals, the same elements will be referenced by the same reference numerals although the elements are illustrated in different drawings. In the following description of the present disclosure, detailed description of known functions and configurations incorporated herein will be omitted when it may make the subject matter of the present disclosure rather unclear.

Terms, such as first, second, A, B, (a), or (b) may be used herein to describe elements of the present disclosure. Each of the terms is not used to define essence, order, sequence, or number of an element, but is used merely to distinguish the corresponding element from another element. When it is mentioned that an element is "connected" or "coupled" to another element, it should be interpreted that another element may be "interposed" between the elements or the elements may be "connected" or "coupled" to each other via another element as well as that one element is directly connected or coupled to another element.

FIG. 1 is a diagram illustrating an entire system configuration of an organic light-emitting display device according to one or more embodiments of the present disclosure.

Referring to FIG. 1, an organic light-emitting display device 100 according to an embodiment of the present disclosure includes a display panel 110 including plural sub pixels SP which are arranged in areas in which plural data lines DL formed in one direction and plural gate lines GL formed in another direction intersecting the plural data lines intersect each other, a data driver 120 that supplies a data voltage via the data lines, a gate driver 130 that supplies a scan signal via the gate lines, and a timing controller 140 that controls driving timings of the data driver 120 and the gate driver 130.

Although not illustrated in the drawing, a voltage supply unit (not illustrated) that supplies various voltages to the organic light-emitting display device 100 is provided, and the voltage supply unit supplies a high-potential voltage EVDD and a low-potential voltage EVSS to the sub pixels.

Referring to FIG. 1, in the display panel 110, plural data lines DL(1) to DL(4N) are formed in one direction and plural gate lines GL(1) to GL(M) are formed in another direction intersecting the data lines DL(1) to DL(4N). In this specification, for the purpose of convenience of explanation, it is assumed that the number of data lines and the number of gate lines formed in the display panel 110 are 4N and M, respectively, but the present disclosure is not limited thereto. Here, N and M are natural numbers equal to or greater than 1. n, which is used to identify each data line of 4N data lines, is a natural number which is equal to or greater than 1 and equal to or less than ¼ of the number of data lines ($1 \leq n \leq (4N/4)$).

In the display panel 110, 4N×M sub pixels SP are defined in areas in which the 4N data lines DL(1) to DL(4N) and the M gate lines GL(1) to GL(M) intersect each other. The structure of each sub pixel SP will be described below in more detail with reference to FIGS. 2A and 2B.

Figure 2A:
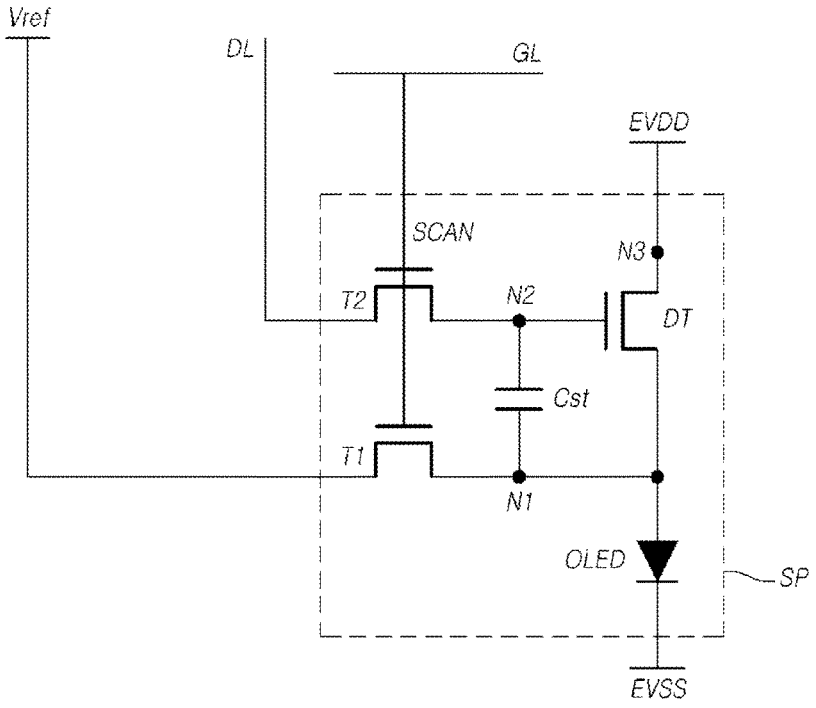
FIGS. 2A and 2B are equivalent circuit diagrams of a sub pixel in a display panel illustrated in FIG. 1.
Figure 2B:
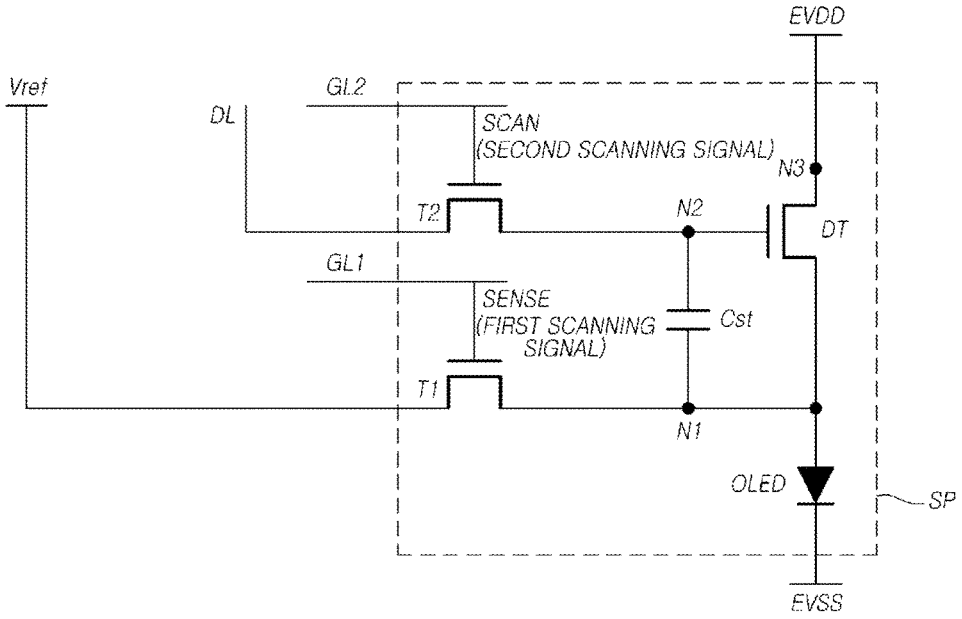

FIGS. 2A and 2B are equivalent circuit diagrams of a single sub pixel in the display panel illustrated in FIG. 1.

Referring to FIG. 2A, each sub pixel SP is connected to one data line DL and is supplied with a single scan signal via one gate line GL.

As illustrated in FIG. 2A, each sub pixel includes an organic light-emitting diode OLED, a driving transistor DT, a first transistor T1, a second transistor T2, and a storage capacitor Cst. In this way, since each sub pixel includes three transistors DT, T1, and T2 and one storage capacitor Cst, it is said that each sub pixel has a 3T (Transistor) 1C (Capacitor) structure.

The driving transistor DT is a transistor that is supplied with a driving voltage (i.e., a high-potential voltage: EVDD) from a driving voltage line DVL and is controlled to drive the organic light-emitting diode OLED by a voltage (i.e., a data voltage) of a gate node N2 which is applied via the second transistor T2.

The driving transistor DT includes a first node N1, a second node N2, and a third node N3, is connected to the first transistor T1 via the first node N1, is connected to the second transistor T2 via the second node N2, and is supplied with the driving voltage EVDD via the third node N3.

For example, the first node N1 of the driving transistor DT may be a source node (which is also referred to as a "source electrode"), the second node N2 of the driving transistor DT may be a gate node (which is also referred to as a "gate electrode"), and the third node N3 of the driving transistor DT may be a drain node (which is also referred to as a "drain electrode"). With a change in transistor type, a change in circuits, or the like, the first node, the second node, and the third node of the driving transistor DT may be changed.

The first transistor T1 is controlled by a scan signal SCAN supplied via the gate line GL and is connected between a reference voltage line RVL for supplying a reference voltage Vref or a connection pattern CP connected to the reference voltage line RVL and the first node N1 of the driving transistor DT. The first transistor T1 is also referred to as a "sensor transistor."

The second transistor T2 is controlled by the scan signal SCAN supplied in common via the gate line GL and is connected between the data line DL and the second node N2 of the driving transistor DT. The second transistor T2 is also referred to as a "switching transistor."

The storage capacitor Cst is connected between the first node N1 and the second node N2 of the driving transistor DT and functions to hold a data voltage for one frame.

As described above, the first transistor T1 and the second transistor T2 are controlled by a single scan signal supplied via the same gate line (a common gate line). In this way, since each sub pixel uses a single scan signal, it is mentioned that each sub pixel has a basic sub pixel structure of "3T1C-based 1 scan structure" in an example.

Regarding the 3T1C-based 1 scan structure, the first transistor T1 is a transistor associated with driving by applying a data voltage to the gate node N2 of the driving transistor DT, and the second transistor T2 is a transistor which may be associated with driving but is basically associated with sensing for compensating for a luminance deviation between sub pixels. The two transistors T1 and T2 have different usage and functions and thus the control thereof using a single scan signal affects associated operations (e.g., an operation in a display mode and an operation in a sensing mode).

Referring to FIG. 2B, one sub pixel SP in the display panel 110 of the organic light-emitting display device 100 may have a 3T1C structure including three transistors DT, T1, and T2 and a single capacitor Cst.

Each sub pixel SP is supplied with two scan signals (a first scan signal and a second scan signal) via two gate lines (a first gate line GL1 and a second gate line GL2). Hereinafter, the first scan signal is also referred to as a "sensing signal SENSE" and the second scan signal is also referred to as a "scan signal SCAN."

In this way, since each sub pixel SP is supplied with two scan signals SCAN and SENSE, the basic sub pixel structure of FIG. 2B is referred to as a "3T1C-based 2 scan structure."

On the other hand, a sub pixel structure of the organic light-emitting display device 100 according to one or more embodiments includes a signal line connection structure associated with connection of each sub pixel to various signal lines such as the data line DL, the gate line GL, the driving voltage line DVL, and the reference voltage line RVL in addition to the basic sub pixel structure (i.e., the 3T1C-based 1 or 2 scan structure) described above with reference to FIGS. 2A and 2B.

In this specification and the drawings, the transistors DT, T1, and T2 are illustrated and described to be of an N type, but this is only for convenience of explanation. With a change in circuit design, all the transistors DT, T1, and T2 may be changed to a P type, or some of the transistors DT, T1, and T2 may be embodied to be of an N type and the other may be embodied to be of a P type. The organic light-emitting diode OLED may be changed to an inverted type.

The transistors DT, T1, and T2 described in this specification are also referred to as thin film transistors (TFTs).

Figure 3:
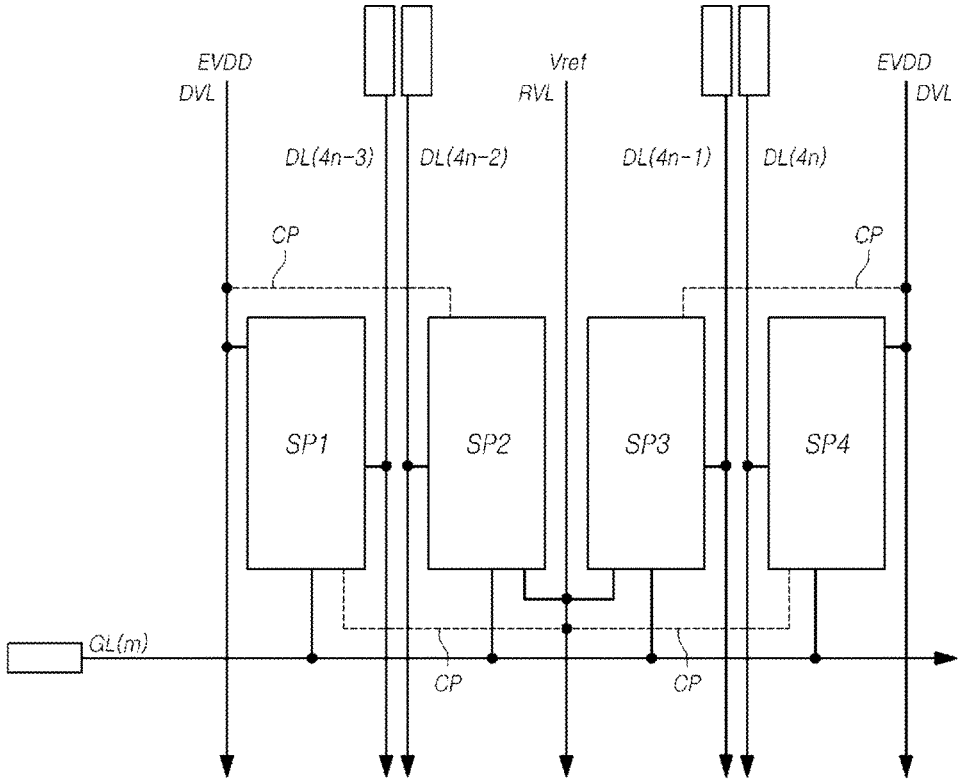
FIG. 3 is a plan view schematically illustrating further details of a part of the display panel illustrated in FIG. 1.
Figure 4:
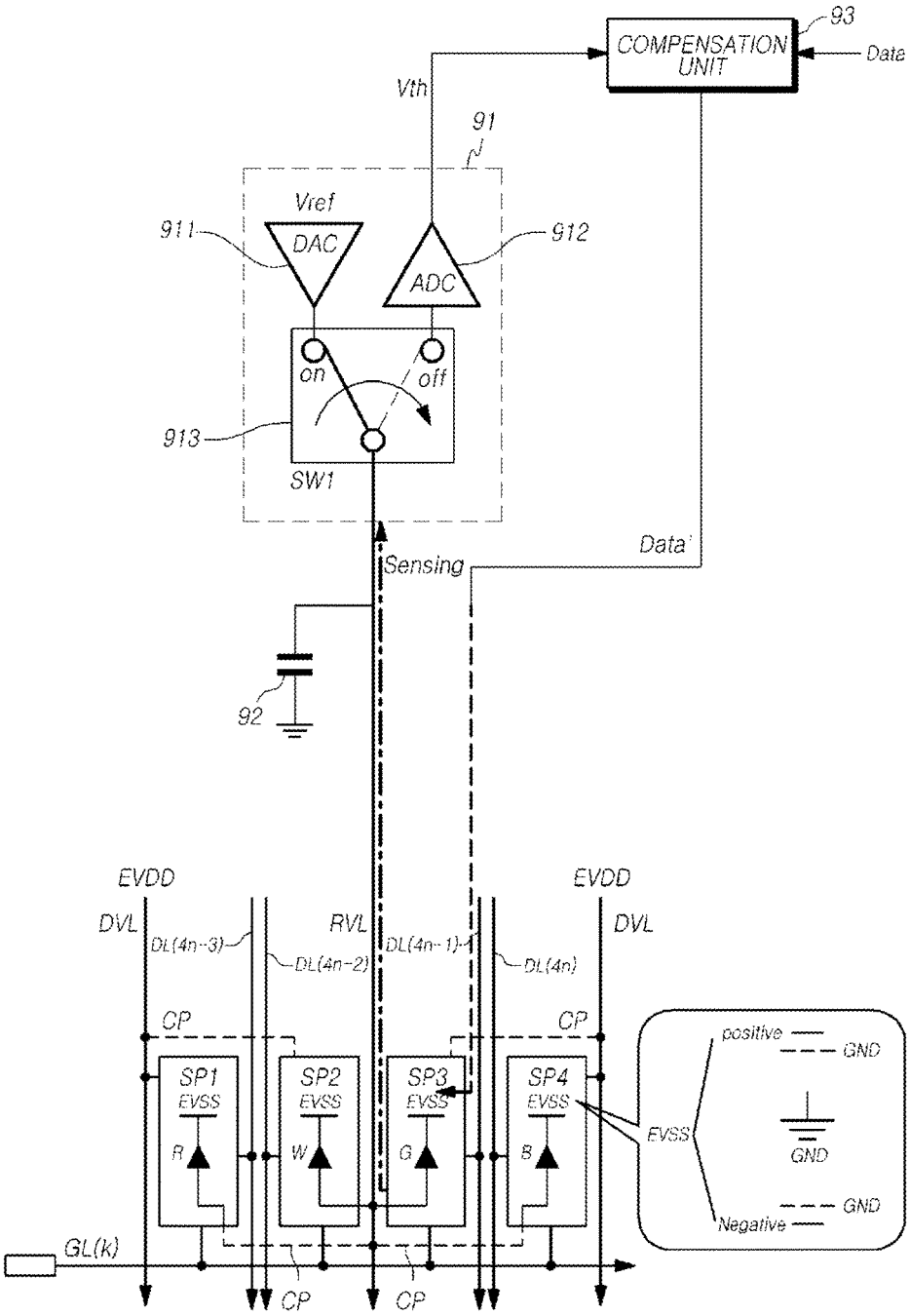
FIG. 4 is a diagram illustrating a sensing mode and a compensation method by a compensation system included in the organic light-emitting display device illustrated in FIG. 1.

The sub pixel structure including the basic sub pixel structure (the 3T1C-based 1 scan structure) and the signal line connection structure mentioned above in brief will be described below in more detail with reference to FIGS. 3 and 4. FIGS. 3 and 4 illustrate an example in which a basic unit of the signal line connection structure includes four sub pixels.

FIG. 3 is a plan view schematically illustrating a part of the display panel illustrated in FIG. 1, and FIG. 4 is a diagram illustrating a sensing mode and a compensation method by a compensation system included in the organic light-emitting display device illustrated in FIG. 1.

Referring to FIG. 3, in an example in which the basic unit of the signal line connection structure includes four sub pixels SP1 to SP4 connected to four data lines DL(4*n*-3), DL(4*n*-2), DL(4*n*-1), and DL(4*n*), the basic sub pixel structure of the 3T1C-based 1 scan structure and the signal line connection structure can be confirmed. Here, it is assumed that the basic unit of the signal line connection structure includes four sub pixels SP1 to SP4 connected to four data lines DL(4*n*-3), DL(4*n*-2), DL(4*n*-1), and DL(4*n*), but the present disclosure is not limited to this example. The basic unit of the signal line connection structure may include two or more sub pixels connected to two or more data lines.

The four data lines DL(4*n*-3), DL(4*n*-2), DL(4*n*-1), and DL(4*n*) are connected to the four sub pixels SP1 to SP4, respectively. One gate line GL(m) (where $1 \leq m \leq M$) is connected to each of the four sub pixels SP1 to SP4.

As illustrated in FIG. 2A, each of the four sub pixels SP1 to SP4 connected to the four data lines DL(4*n*-3), DL(4*n*-2), DL(4*n*-1), and DL(4*n*) includes a driving transistor DT that is supplied with a driving voltage EVDD and drives the organic light-emitting diode OLED, a first transistor T1 that is supplied with a reference voltage Vref to transmit the reference voltage to the first node N1 of the driving transistor DT, a second transistor T2 that is supplied with a data voltage Vdata and transmits the data voltage to the second node N2 of the driving transistor DT, and a capacitor Cst that is connected between the first node N1 and the second node N2 of the driving transistor DT.

In this way, each of the four sub pixels SP1 to SP4 connected to the four data lines DL(4*n*-3), DL(4*n*-2), DL(4*n*-1), and DL(4*n*) has a 3T1C structure including three transistors DT, T1, and T2 and one capacitor Cst in common and has a structure in which only one scan signal is supplied to the first transistor T1 and the second transistor T2 (i.e., the 3T1C-based 1 scan structure illustrated in FIG. 2A) or a structure in which scan signals are supplied to the first transistor T1 and the second transistor T2, respectively (i.e., the 3T1C-based 2 scan structure illustrated in FIG. 2B).

As described above, the signal lines include the reference voltage line RVL for supplying the reference voltage Vref to each sub pixel, the driving voltage line DVL for supplying the driving voltage EVDD to each sub pixel, the low-voltage line for supplying the low-potential voltage EVSS to the cathode of the organic light-emitting diode OLED of each sub pixel, in addition to the data line for supplying the data voltage to each sub pixel and the gate line for supplying the scan signal to each sub pixel.

When the basic unit of the signal line connection structure includes four sub pixels (four sub pixel columns), the number of reference voltage lines RVL may be ¼ of the number of data lines. That is, when the number of data lines is 4N, the number of reference voltage lines RVL may be N. As described above, when the basic unit of the signal line connection structure includes two or more sub pixels, the number of reference voltage lines RVL may be 1/(the number of sub pixels of the basic unit) of the number of data lines.

As described above, when the basic unit of the signal line connection structure includes four sub pixels (four sub pixel columns), the reference voltage line connection structure is as follows.

When only the sub pixels SP1 to SP4 which can be supplied with data voltages from four data lines DL(4*n*-3), DL(4*n*-2), DL(4*n*-1), and DL(4*n*) (where $1 \leq n \leq N$), that is, the sub pixels SP1 to SP4 connected to four data lines DL(4*n*-3), DL(4*n*-2), DL(4*n*-1), and DL(4*n*), are considered, one reference voltage line RVL is formed in parallel to (e.g., along a same direction as) the data lines in the display panel 110 for the sub pixels SP1 to SP4 connected to the four data lines DL(4*n*-3), DL(4*n*-2), DL(4*n*-1), and DL(4*n*).

The one reference voltage line RVL is directly connected to the sub pixels connected to two of the data lines (for example, sub pixels SP2 and SP3 which are connected to the data lines DL(4*n*-2) and DL(4*n*-1), respectively) among the four data lines DL(4*n*-3), DL(4*n*-2), DL(4*n*-1), and DL(4*n*) and can supply the reference voltage Vref thereto.

In this specification and the drawings, the sub pixel connected to the (4*n*-3)-th data line DL(4*n*-3), the sub pixel connected to the (4*n*-2)-th data line DL(4*n*-2), the sub pixel connected to the (4*n*-1)-th data line DL(4*n*-1), and the sub pixel connected to the 4n-th data line DL(4*n*) are, for example, a red (R) sub pixel, a green (G) sub pixel, a blue (B) sub pixel, and a white (W) sub pixel, respectively, but the present disclosure is not limited to this example. The sub pixels may be a red (R) sub pixel, a white (W) sub pixel, a green (G) sub pixel, and a blue (B) sub pixel, respectively, in another example, or may be a red (R) sub pixel, a white (W) sub pixel, a blue (B) sub pixel, and a green (G) sub pixel, respectively, in yet another example.

FIG. 4 specifically illustrates the operation in the sensing mode and the compensation method on the basis of the sub pixels having the above-mentioned structure, in accordance with one or more embodiments.

The compensation system of the organic light-emitting display device 100 includes a sensing unit 91 that senses a degree of degradation and a compensation unit 93 that compensates for degradation of the driving transistor DT or the organic light-emitting diode OLED in each sub pixel SP on the basis of the sensed degree of degradation in order to compensate for the degradation of the driving transistor DT or the organic light-emitting diode OLED in each sub pixel. The degradation of the driving transistor DT or the organic light-emitting diode OLED, if not compensated for, may cause luminance unevenness in the sub pixels.

The sensing unit 91 can sense a degree of degradation of one of the four sub pixels SP1 to SP4 via the reference voltage line connected to one of every two electrodes of the four sub pixels SP1 to SP4. In the sub pixel structure in which one of every two electrodes of the four sub pixels SP1 to SP4 is connected to one reference voltage line, since the threshold voltage of each organic light-emitting diode of the sub pixels SP1 to SP4 cannot be sensed, the threshold voltage of the organic light-emitting diode OLED having the lowest threshold voltage among the four sub pixels SP1 to SP4 is sensed via the reference voltage line connected to one of every two electrodes of the four sub pixels SP1 to SP4. Since degradation characteristics of the organic light-emitting diodes OLED of the four sub pixels SP1 to SP4 which are uniformly located have positional uniformity, a degree of degradation of the other sub pixels can be estimated using the sensed threshold voltage of one organic light-emitting diode OLED.

The sensing unit 91 senses the threshold voltage to estimate the degree of degradation of the driving transistor DT or the organic light-emitting diode OLED in each sub pixel. The voltage of the first node (N1) of the driving transistor DT of each sub pixel SP or the first node N1 which is one of two electrodes of the organic light-emitting diode OLED can be sensed.

Here, the sensing of the threshold voltage of the driving transistor DT or the organic light-emitting diode OLED can be performed in a non-display period after the organic light-emitting display device 100 is powered on and before an image is displayed. That is, the sensing of the threshold voltage of the driving transistor DT or the organic light-emitting diode OLED can be performed whenever the organic light-emitting display device 100 is powered on.

The sensing unit 91 includes a digital-analog converter (DAC) 911 that converts the reference voltage Vref supplied from a reference voltage source into an analog value, an analog-digital converter (ADC) 912 that converts the sensed voltage of the first node N1 of the driving transistor DT of each sub pixel SP which can be connected to the sensing unit 91 or the first node N1 which is one of two electrodes of the organic light-emitting diode OLED into a digital value, and a first switch 913 that switches to connect one of a reference voltage supply node supplied with the reference voltage Vref converted into the analog value by the digital-analog converter 911, and a sensing node connected to the analog-digital converter 912 to the reference voltage line RVL.

The sensing unit 91 can supply the reference voltage to the four sub pixels SP1 to SP4 via the reference voltage line RVL until a constant voltage is discharged, and can sense the degree of degradation of the driving transistor DT or the organic light-emitting diode OLED of the sub pixel SP having the lowest degree of degradation via the reference voltage line RVL.

For example, when the operation mode of the organic light-emitting display device 100 is switched from the display mode to the sensing mode, the voltage of the first node N1 of each sub pixel connected to the reference voltage line RVL is sensed and a line capacitor 92 is charged with the sensed voltage.

The sensed voltage Vsen is converted into a digital value by the ADC 912, and the compensation unit 93 generates a compensation data voltage on the basis of the converted digital value.

In this way, the organic light-emitting display device operates in the display mode and the sensing mode, and the sensing mode is classified into a degradation sensing mode for the driving transistor DT and a degradation sensing mode for the organic light-emitting diode OLED.

Here, the base voltage supplied to the cathode of the organic light-emitting diode of each sub pixel in the display mode of the organic light-emitting display device is the ground GND (0 [V]), the base voltage supplied to the cathode of the organic light-emitting diode of each sub pixel in the degradation sensing mode for the driving transistor DT is a positive voltage, and the base voltage supplied to the cathode of the organic light-emitting diode of each sub pixel in the degradation sensing mode for the organic light-emitting diode OLED is a negative voltage, In this way, when the base voltage EVSS supplied to each sub pixel differs depending on the operation mode of the organic light-emitting display device, voltage generation circuits for generating the base voltages EVSS are required.

When the voltage generation circuits are additionally arranged, there is a problem in that the circuit configuration of the organic light-emitting display device is complicated and the product price increases due to the additional components.

In one or more embodiments provided by the present disclosure, the base voltage EVSS can be selectively supplied to each sub pixel SP of the display panel 110 by disposing a voltage conversion circuit between the voltage supply unit and the display panel 110 in the organic light-emitting display device or integrally with the voltage supply unit.

That is, according to embodiments of the present disclosure, it is possible to selectively output the base voltage supplied to the cathode of the organic light-emitting diode of each sub pixel depending on whether the display panel operates in the display mode or the sensing mode.

Figure 5:
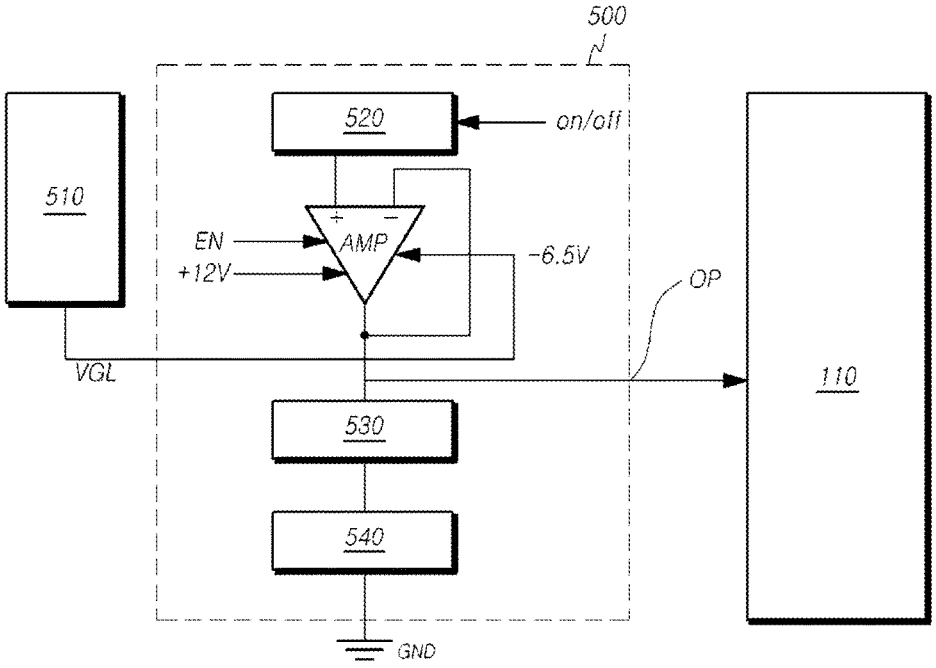
FIG. 5 is a diagram illustrating a voltage conversion circuit disposed in the organic light-emitting display device according to one or more embodiments of the present disclosure.

FIG. 5 is a diagram illustrating the voltage conversion circuit disposed in the organic light-emitting display device according to one or more embodiments of the present disclosure.

Referring to FIG. 5, the organic light-emitting display device 100 according to embodiments of the present disclosure includes a display panel 110, a voltage supply unit 510 that supplies various voltages required for the display panel 100, and a voltage conversion circuit 500 that is disposed between the display panel 110 and the voltage supply unit 510 to selectively supply different base voltages EVSS to the display panel 110.

The voltage conversion circuit 500 includes a reference voltage setting unit 520 that generates a positive voltage and a negative voltage to be supplied to the display panel, an amplifier AMP that is supplied with the positive voltage or the negative voltage output from the reference voltage setting unit 520 via an input terminal and outputs the positive voltage or the negative voltage via an output terminal, and first and second switching units 530 and 540 that are disposed between the output terminal OP of the amplifier AMP and the ground GND.

The operation of the reference voltage setting unit 520 is controlled by an ON/OFF signal, and the operation of the amplifier AMP is controlled by an enable signal EN or a disable signal DISABLE.

The amplifier AMP further includes a first power supply terminal Vcc having a positive polarity and a second power supply terminal −Vcc having a negative polarity so as to swing the output voltage of the output terminal OP to a positive side and a negative side with respect to the voltage supplied to the input terminal.

For example, when the voltage supplied to the first power supply terminal Vcc is 12 [V] and the voltage supplied to the second power supply terminal −Vcc is −6.5 [V], the swing range which can be output from the amplifier AMP is 12 [V] to −6.5 [V] and thus the voltage conversion circuit 500 can selectively supply the positive base voltage EVSS or the negative base voltage EVSS to the display panel 110.

The second power supply terminal −Vcc supplied with the negative voltage among the first and second power supply terminals Vcc and −Vcc of the amplifier AMP can be supplied with a gate-low voltage VGL of the scan signal among the voltages output from the voltage supply unit 510. Accordingly, a particular power supply for the second power supply terminal −Vcc may not be used.

Although not illustrated in the drawing, a voltage source for the first power supply terminal Vcc may be separately provided or one positive voltage of the voltages output from the voltage supply unit 510 may be used.

In the voltage conversion circuit 500 and the organic light-emitting display device including the voltage conversion circuit according to embodiments of the present disclosure, it is possible to reduce the number of components and to achieve a decrease in size by selectively supplying the base voltages (the positive voltage, the negative voltage, and the ground voltage) required for each sub pixel depending on whether the display panel operates in the display mode or the sensing mode.

Figure 6A:
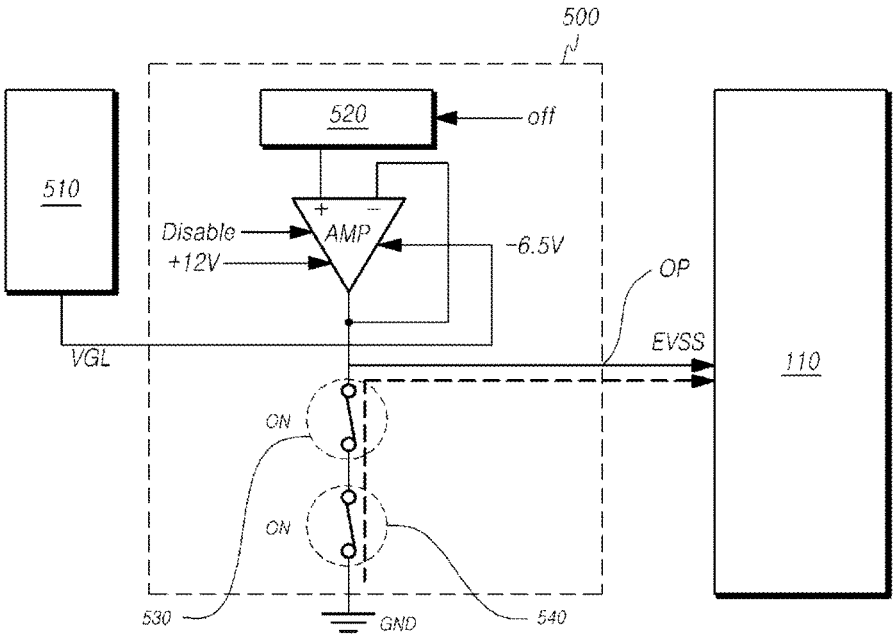
FIGS. 6A to 6C are diagrams illustrating different base voltages which are output from a voltage conversion circuit depending on whether the organic light-emitting display device according to embodiments of the present disclosure operates in a display mode or in a sensing mode.
Figure 6B:
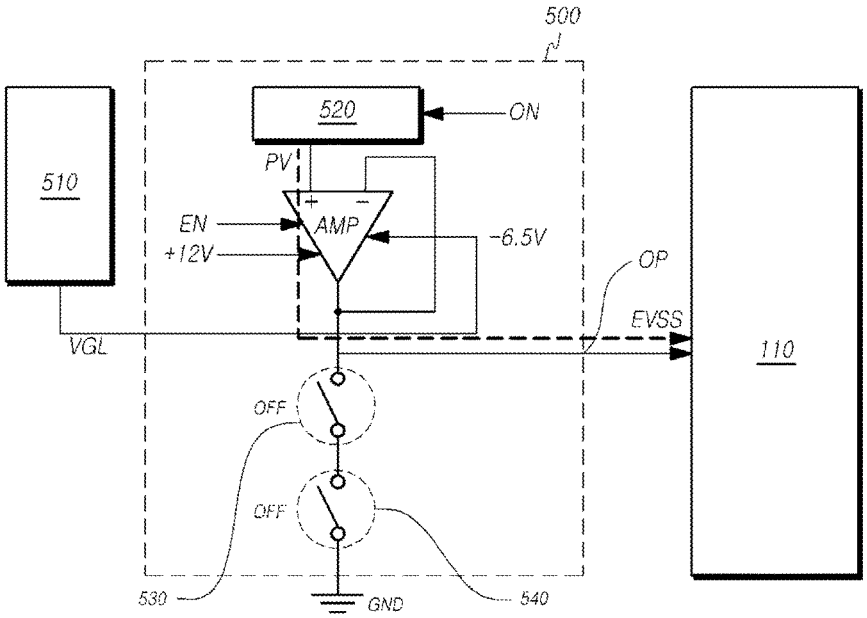
Figure 6C:
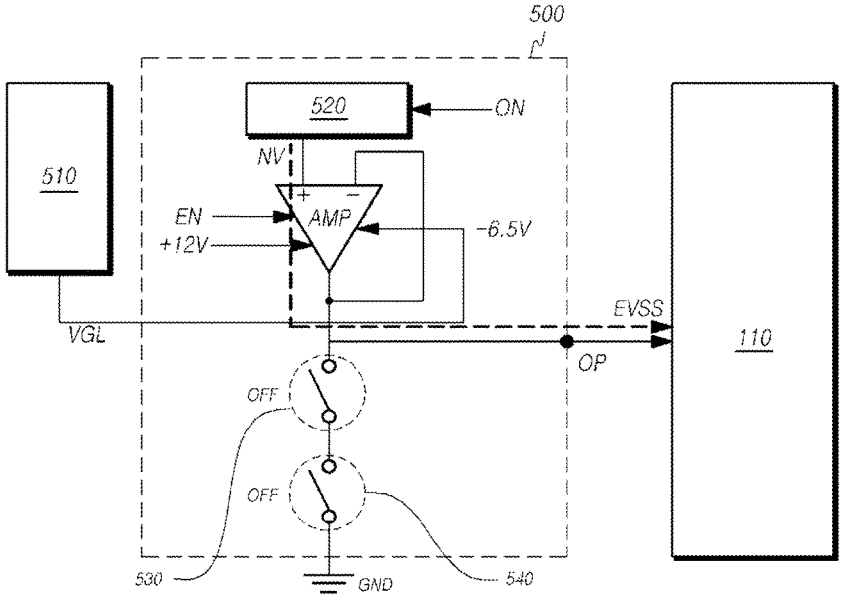

FIGS. 6A to 6C are diagrams illustrating different base voltages which are output from the voltage conversion circuit depending on whether the organic light-emitting display device according to embodiments of the present disclosure operates in the display mode or the sensing mode.

FIG. 6A is a diagram illustrating a state in which the base voltage EVSS of the ground voltage GND is output from the voltage conversion circuit 500 when the organic light-emitting display device operates in the display mode. As illustrated in the drawing, the reference voltage setting unit 520 of the voltage conversion circuit 500 is turned off and does not output the positive voltage or the negative voltage to the input terminal (+) of the amplifier AMP.

When the amplifier AMP is supplied with a disable signal and thus is not activated, the resistance when the input terminal (+) of the amplifier AMP is viewed from the output terminal of the amplifier AMP is almost infinite. Accordingly, since the amplifier AMP is disabled, no voltage is output regardless of turning-on/off of the reference voltage setting unit 520.

The first and second switching units 530 and 540 are turned on and the output terminal OP (the same as the output terminal of the amplifier) of the voltage conversion circuit 500 is electrically connected to the ground GND. Accordingly, the ground voltage is output from the output terminal of the voltage conversion circuit 500 and the ground voltage functions as the base voltage EVSS for each sub pixel of the display panel.

Referring to FIG. 6B, by causing the voltage conversion circuit 500 to output the positive voltage as the base voltage EVSS, the positive voltage can be provided as the base voltage EVSS to be supplied to each sub pixel in the sensing mode for compensating for the degradation of the driving transistor DT of each sub pixel SP of the organic light-emitting display device 100.

As illustrated in the drawing, the reference voltage setting unit 520 is turned on and the reference voltage setting unit 520 supplies the positive voltage to the input terminal (+) of the amplifier AMP. At this time, the first and second switching units 530 and 540 are turned off.

The amplifier AMP is supplied with the enable signal and the positive voltage input to the input terminal (+) is supplied to the display panel via the output terminal OP of the amplifier AMP.

Since the positive voltage is within a range of a first source voltage Vcc, the positive voltage can be adjusted to various values depending on the voltage value Vcc.

In FIG. 6C, in the sensing mode for compensating for the degradation of the organic light-emitting diode OLED when the organic light-emitting display device 100 according to embodiments of the present disclosure operates in the sensing mode, each sub pixel of the display panel 110 can be provided with the negative voltage as the base voltage EVSS.

As illustrated in the drawing, the reference voltage setting unit 520 supplies the negative voltage (NV) to the input terminal (+) of the amplifier AMP and the first and second switching units 530 and 540 are turned off.

Since the amplifier AMP is supplied with the enable signal, the negative voltage supplied to the input terminal (+) of the amplifier AMP is supplied as the base voltage EVSS of each sub pixel of the display panel 110 via the output terminal OP of the amplifier AMP.

In this way, in the voltage conversion circuit and the organic light-emitting display device according to embodiments of the present disclosure, it is possible to selectively output the base voltage to be supplied to the cathode of the organic light-emitting diode of each sub pixel depending on whether the display panel operates in the display mode or the sensing mode.

Figure 7:
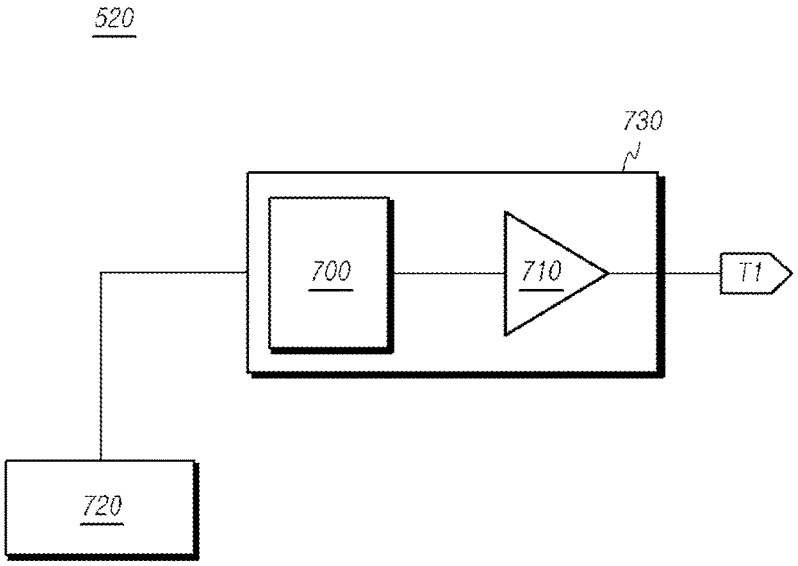
FIGS. 7 and 8 are diagrams illustrating examples of a configuration of a reference voltage setting unit disposed in the voltage conversion circuit according to embodiments of the present disclosure.
Figure 8:
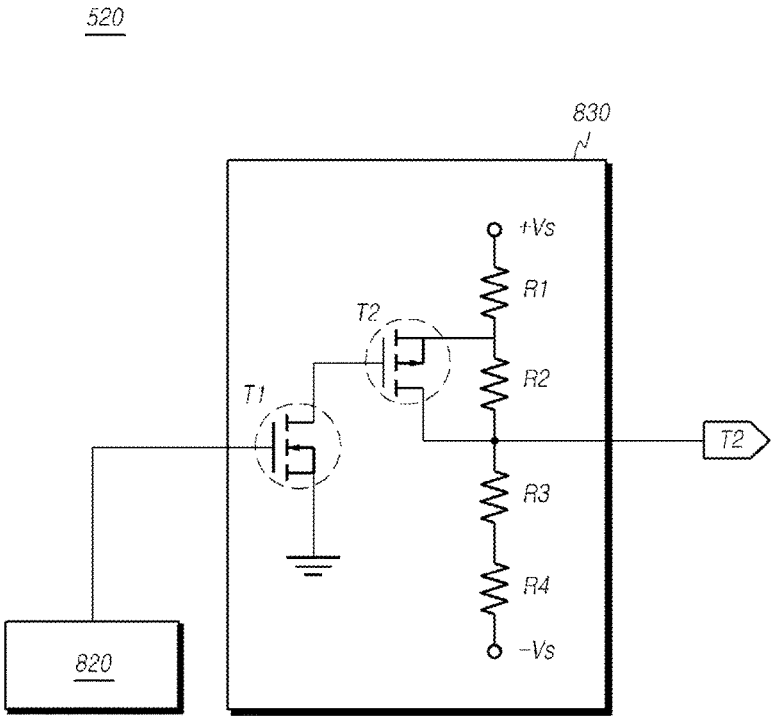

FIGS. 7 and 8 are diagrams illustrating examples of the configuration of the reference voltage setting unit which is disposed in the voltage conversion circuit according to embodiments of the present disclosure.

Referring to FIG. 7, the reference voltage setting unit 520 of the voltage conversion circuit 500 according to embodiments of the present disclosure includes a first controller 720 and a first voltage generator 730 that generates the base voltages EVSS under the control of the first controller 720.

The first voltage generator 730 includes a register 700 that stores information of the voltages to be generated and an amplifier 710 that outputs a voltage on the basis of the information of the register 700.

FIG. 8 illustrates another example embodiment of the present disclosure. The reference voltage setting unit 520 includes a second controller 820 and a second voltage generator 830 that generates a positive voltage, a ground voltage (0 [V]), and a negative voltage in response to a control signal (a turn-on/turn-off signal) of the second controller 820.

In the second voltage generator 830, Vs and −Vs are connected to respective ends of resistors (R) which are connected in series, and the voltage between Vs and −Vs is divided by first and second transistors T1 and T2 to output the base voltage. For example, when a turn-on signal is output from the second controller 820, the positive voltage is output to the amplifier AMP by the first and second transistors T1 and T2 of the second voltage generator 830. When a turn-off signal is output from the second controller 820, the negative voltage is output to the amplifier AMP by the first and second transistors T1 and T2 of the second voltage generator 830.

Figure 9:
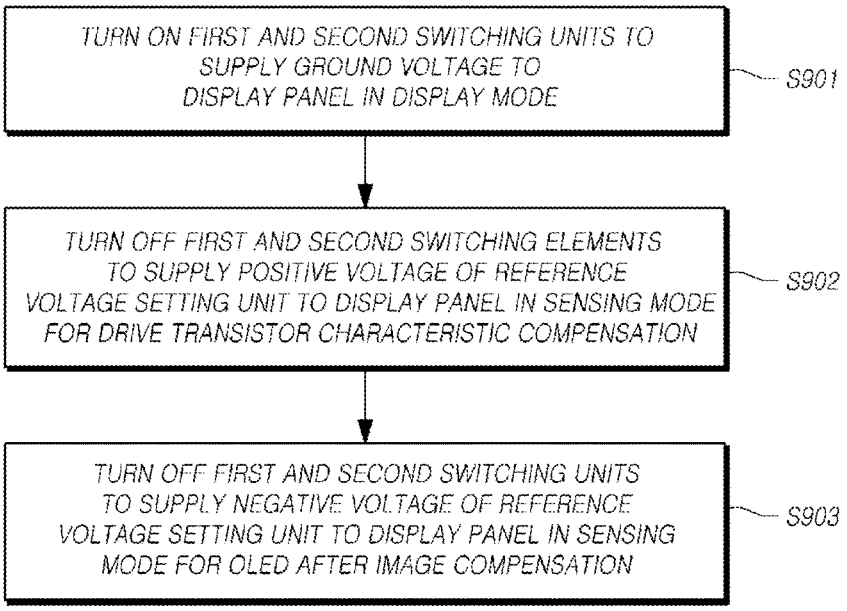
FIG. 9 is a diagram illustrating a driving method of the voltage conversion circuit depending on the modes of the organic light-emitting display device according to embodiments of the present disclosure.

FIG. 9 is a diagram illustrating a driving method of the voltage conversion circuit depending on the modes of the organic light-emitting display device according to one or more embodiments of the present disclosure.

Referring to FIGS. 5 and 9, the driving method of the organic light-emitting display device according to embodiments of the present disclosure includes a step of turning on the first and second switching units disposed in the voltage conversion circuit to supply the ground voltage of the ground connected to the switching units to the display panel in the display mode (S901).

When the organic light-emitting display device operates in the sensing mode for compensating for the characteristic value of the driving transistor of each sub pixel, the first and second switching units of the voltage conversion circuit are both turned off.

Then, the positive voltage output from the reference voltage setting unit 520 is supplied to the display panel 110 via the amplifier AMP. The positive voltage functions as a cathode voltage, that is, a base voltage EVSS, of the organic light-emitting diode of each sub pixel of the display panel 110 (S902).

When the sensing for compensating for the characteristic value of the driving transistor is completed, the operation mode is switched to the sensing mode for compensating for an afterimage due to degradation of the organic light-emitting diode and the first and second switching units of the voltage supply unit 510 are both turned off.

Then, the negative voltage output from the reference voltage setting unit 520 is supplied to the display panel 110 via the amplifier AMP. The negative voltage functions as a cathode voltage, that is, a base voltage EVSS, of the organic light-emitting diode of each sub pixel of the display panel 110 (S903).

In this way, in the voltage conversion circuit and the organic light-emitting display device according to embodiments of the present disclosure, it is possible to selectively output the base voltage to be supplied to the cathode of the organic light-emitting diode of each sub pixel depending on whether the display panel operates in the display mode or the sensing mode.

The above description and the accompanying drawings provide an example of the technical idea of the present disclosure for illustrative purposes only. Those skilled in the art will appreciate that various modifications and changes such as combinations, separations, substitutions, and changes of configurations are possible without departing from the essential features of the present disclosure. Therefore, the embodiments disclosed herein are intended to illustrate, not define, the technical idea of the present disclosure, and the scope of the present disclosure is not limited to the embodiments. The scope of the present disclosure shall be construed on the basis of the appended claims in such a manner that all the technical ideas within the range equivalent to the claims belong to the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light-emitting display device, comprising:

a display panel in which data lines and gate lines are arranged in intersecting directions and a plurality of sub pixels are arranged at respective regions of intersections of the data lines and gate lines;

a data driver configured to supply a data voltage to the display panel via the data lines;

a gate driver configured to supply a scan signal to the display panel via the gate lines;

a timing controller configured to control driving timings of the data driver and the gate driver;

a voltage supply circuit configured to supply voltages to the timing controller and the gate driver; and a voltage conversion circuit configured to selectively supply different supply voltages to the plurality of sub pixels of the display panel when the display panel operates in a display mode, in a driving transistor degradation sensing mode, and in an organic light-emitting diode (OLED) degradation sensing mode, wherein the voltage conversion circuit supplies a first voltage in the display mode, a second voltage in the driving transistor degradation sensing mode, and a third voltage in the OLED degradation sensing mode, the second voltage being higher than the first voltage, the third voltage being lower than the first voltage.

2. The organic light-emitting display device according to claim 1, wherein the voltage conversion circuit includes:

a reference voltage setting circuit configured to generate a positive voltage and a negative voltage to be supplied to the display panel;

an amplifier configured to receive the positive voltage in the driving transistor degradation sensing mode, and the negative voltage in the OLED degradation sensing mode, output from the reference voltage setting circuit via an input terminal and to output the received positive voltage or the negative voltage from an output terminal; and first and second switching units disposed between the output terminal of the amplifier and an electrical ground.

3. The organic light-emitting display device according to claim 2, wherein the amplifier includes first and second power supply terminals, wherein the first power supply terminal is supplied with a positive bias voltage and the second power supply is supplied with a negative bias voltage.

4. The organic light-emitting display device according to claim 3, wherein the first power supply terminal is supplied with 12 volts and the second power supply terminal is supplied with −6.5 volts.

5. The organic light-emitting display device according to claim 3, wherein the second power supply terminal is supplied with a gate-low voltage which is supplied from the voltage supply circuit.

6. The organic light-emitting display device according to claim 2, wherein the reference voltage setting circuit includes:

a controller configured to control generation of the positive voltage and the negative voltage; and a voltage generator configured to output the positive voltage in the driving transistor degradation sensing mode and the negative voltage in the OLED degradation sensing mode in response to a control signal from the controller.

7. The organic light-emitting display device according to claim 6, wherein the voltage generator includes a register and a second amplifier.

8. A method, comprising:

coupling an output of a voltage conversion circuit to a ground voltage, in a display mode, the output of the voltage conversion circuit being coupled to a cathode of an organic light-emitting diode (OLED) of a sub pixel in a display panel;

generating, by the voltage conversion circuit, a first supply voltage in a driving transistor degradation sensing mode, and providing the first supply voltage to the output of the voltage conversion circuit coupled to the cathode of the OLED; and generating, by the voltage conversion circuit, a second supply voltage in an OLED degradation sensing mode, and providing the second supply voltage to the output of the voltage conversion circuit coupled to the cathode of the OLED, wherein the first supply voltage is greater than the ground voltage, and the second supply voltage is less than the ground voltage.

9. The method of claim 8, wherein the first supply voltage is a positive supply voltage and the second supply voltage is a negative supply voltage.

10. The method of claim 9, wherein generating, by the voltage conversion circuit, the positive and negative supply voltages comprises:

generating, by a reference voltage setting circuit, a positive reference voltage in the driving transistor degradation sensing mode;

generating, by an amplifier coupled to the reference voltage setting circuit, the positive supply voltage based on the received positive reference voltage, in the driving transistor degradation sensing mode;

generating, by the reference voltage setting circuit, a negative reference voltage in the OLED degradation sensing mode; and generating, by the amplifier, the negative supply voltage based on the received negative reference voltage, in the OLED degradation sensing mode.

11. The method of claim 8, wherein coupling the output of the voltage conversion circuit to the ground voltage in the display mode includes coupling the cathode to the ground voltage through one or more switches that are coupled between the output of the voltage conversion circuit and the ground voltage.

12. The method of claim 8, further comprising:

compensating for degradation of a drive transistor in the sub pixel using the first supply voltage provided in the drive transistor degradation sensing mode; and compensating for degradation of the OLED in the sub pixel using the second supply voltage provided in the OLED degradation sensing mode.

13. A voltage conversion circuit for use in an organic light emitting diode display device, comprising:

a display panel that receives supply voltages;

a reference voltage setting circuit configured to generate a positive voltage in a first operational mode and a negative voltage in a second operational mode, and to supply the generated voltage to the display panel;

an amplifier configured to receive the voltage output from the reference voltage setting circuit via an input terminal and to output the positive voltage in the first operational mode, and the negative voltage in the second operational mode, from an output terminal; and first and second switching units disposed between the output terminal of the amplifier and an electrical ground, wherein the first operational mode is a driving transistor degradation sensing mode and the second operational mode is an organic light-emitting diode (OLED) degradation sensing mode.

14. The voltage conversion circuit according to claim 13, wherein the amplifier includes first and second power supply terminals, wherein the first power supply terminal is supplied with a positive bias voltage and the second power supply is supplied with a negative bias voltage.

15. The voltage conversion circuit according to claim 14, wherein the first power supply terminal is supplied with 12 volts and the second power supply terminal is supplied with −6.5 volts.

16. The voltage conversion circuit according to claim 14, wherein the second power supply terminal is supplied with a gate-low voltage from a voltage supply unit.

17. The voltage conversion circuit according to claim 13, wherein the reference voltage setting circuit includes:

a controller configured to control generation of the positive voltage and the negative voltage; and a voltage generator configured to output the positive voltage in the first operational mode and the negative voltage in the second operational mode in response to a control signal from the controller.

18. The voltage conversion circuit according to claim 17, wherein the voltage generator includes a register and a second amplifier.

* * * * *